US011484750B2

(12) United States Patent
Silver et al.

(10) Patent No.: US 11,484,750 B2
(45) **Date of Patent: *Nov. 1, 2022**

(54) CLIMBER EXERCISE MACHINE

(71) Applicant: DRIP FITNESS LLC, Charlotte, NC (US)

(72) Inventors: Robert Silver, Charlotte, NC (US); Russell Sinacori, Charlotte, NC (US); Darren Tarver, Deerfield Beach, FL (US)

(73) Assignee: DRIP FITNESS, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/355,593

(22) Filed: Jun. 23, 2021

(65) Prior Publication Data

US 2021/0322822 A1 Oct. 21, 2021

Related U.S. Application Data

(63) Continuation of application No. 16/881,210, filed on May 22, 2020, now Pat. No. 11,298,587.

(Continued)

(51) Int. Cl.
*A63B 22/20* (2006.01)
*A63B 22/00* (2006.01)

(Continued)

(52) U.S. Cl.
CPC ..... *A63B 22/205* (2013.01); *A63B 21/00069* (2013.01); *A63B 21/151* (2013.01);

(Continued)

(58) Field of Classification Search
CPC ... A63B 22/205; A63B 22/001; A63B 21/151; A63B 22/04; A63B 21/00069;

(Continued)

(56) References Cited

U.S. PATENT DOCUMENTS 4,958,830 A * 9/1990 Huggins ..... A61H 1/0259 482/52
4,982,952 A * 1/1991 Wang ..... A63B 23/03583 482/53

(Continued)

FOREIGN PATENT DOCUMENTS

CN 102671345 A 9/2012
CN 204275410 U 4/2015

(Continued)

OTHER PUBLICATIONS

Xebex Fitness, Climber CBR-01, accessed at: https://www.xebex.eu/store/p50/CLIMBER_CBR-01%C2%A0%C2%A0.html, May 3, 2019, 3 pages.

(Continued)

*Primary Examiner* — Andrew S Lo
*Assistant Examiner* — Andrew M Kobylarz
(74) *Attorney, Agent, or Firm* — NK Patent Law

(57) ABSTRACT

Climber exercise machine comprises a frame connected to a base through a base connection, the frame pivotable about the base connection. A right handle and a left handle are connected to respective right and left sides of the frame, the right handle moving within a first range of motion, the left handle moving within a second range of motion. A right pedal and a left pedal are connected to the respective right and left sides of the frame, the right pedal moving within a third range of motion, the left pedal moving within a forth range of motion. The right handle, the left handle, the right pedal, and the left pedal movable generally in the same plane. An angle between the frame and a plane parallel to an underside of the base is adjustable while the climber exercise machine is mounted by a user.

28 Claims, 5 Drawing Sheets

Related U.S. Application Data

(60) Provisional application No. 62/855,017, filed on May 31, 2019.

(51) Int. Cl.

| | |
|---|---|
| ***A63B 21/00*** | (2006.01) |
| ***A63B 22/04*** | (2006.01) |
| ***A63B 24/00*** | (2006.01) |
| ***A63B 71/06*** | (2006.01) |
| ***A63B 23/035*** | (2006.01) |

(52) U.S. Cl.
CPC ..... *A63B 22/001* (2013.01); *A63B 22/04* (2013.01); *A63B 23/03575* (2013.01); *A63B 24/0087* (2013.01); *A63B 71/0622* (2013.01); *A63B 2024/009* (2013.01); *A63B 2071/0644* (2013.01); *A63B 2220/36* (2013.01); *A63B 2225/09* (2013.01)

(58) Field of Classification Search
CPC ..... A63B 24/0087; A63B 71/0622; A63B 23/03575; A63B 2225/09; A63B 2220/36; A63B 2024/009; A63B 2071/0644; A63B 2225/682; A63B 2071/0636; A63B 2220/806; A63B 2225/50; A63B 2230/50; A63B 2071/0675; A63B 2071/0666; A63B 2230/75; A63B 2220/833; A63B 2225/64; A63B 2071/0625; A63B 2220/30; A63B 2230/06; A63B 2225/20; A63B 2208/0204; A63B 2210/58; A63B 2220/807
See application file for complete search history.

(56) References Cited

U.S. PATENT DOCUMENTS

| | | | | |
|---|---|---|---|---|
| D323,008 | S * | 1/1992 | Wang | D21/670 |
| 5,256,117 | A * | 10/1993 | Potts | A63B 21/157 482/52 |
| 5,492,515 | A * | 2/1996 | Charnitski | A63B 22/205 482/37 |
| 5,679,100 | A | 10/1997 | Charnitski | |
| 5,803,880 | A * | 9/1998 | Allen | A63B 21/0087 482/37 |
| 8,540,609 | B2 | 9/2013 | Anderson et al. | |
| 8,801,578 | B2 * | 8/2014 | Corbalis | A63B 24/0075 482/901 |
| 9,358,421 | B2 | 6/2016 | Mercenari Uribe | |
| 9,878,194 | B2 | 1/2018 | Young | |
| 10,179,260 | B1 * | 1/2019 | Stearns | A63B 21/4034 |
| 10,507,354 | B2 * | 12/2019 | Kiani | A63B 21/00192 |
| 11,298,587 | B2 * | 4/2022 | Silver | A63B 22/04 |
| 2018/0021625 | A1 | 1/2018 | Michaels | |
| 2018/0056111 | A1 * | 3/2018 | Chiang | A63B 22/0605 |
| 2018/0111019 | A1 * | 4/2018 | Ellis | A63B 22/0023 |
| 2018/0207485 | A1 * | 7/2018 | Sun | A63F 13/212 |
| 2019/0009129 | A1 * | 1/2019 | Liao Lai | A63B 23/03591 |
| 2019/0232106 | A1 * | 8/2019 | Dalmia | A63B 21/1609 |
| 2021/0220696 | A1 * | 7/2021 | Carruthers | A63B 22/0005 |

FOREIGN PATENT DOCUMENTS

| | | | |
|---|---|---|---|
| CN | 108434654 | A | 8/2018 |
| EP | 3470121 | A1 | 4/2019 |

OTHER PUBLICATIONS

"Assembly & Operations Manual: Home Model VersaClimber H & HP", Versa Gimber, 2017, 48 pages.
USPTO; Non-Final Office Action for U.S. Appl. No. 16/881,210 dated Aug. 18, 2021, 38 pages.

* cited by examiner

CLIMBER EXERCISE MACHINE

CROSS-REFERENCE TO RELATED APPLICATIONS

This application is a continuation of U.S. patent application Ser. No. 16/881,210 entitled "CLIMBER EXERCISE MACHINE", filed on May 22, 2020, which claims priority to U.S. Provisional Patent Application No. 62/855,017 filed on May 31, 2019, the entire contents of which is incorporated by reference herein.

TECHNICAL FIELD

The present invention relates generally to an exercise machine, and specifically, to an improved climbing exercise machine.

BACKGROUND

Many people intend to improve their overall physical fitness and cardiovascular capability and exercise devices can help with that. Exercise devices provide a wide range of motions and activities for increasing physical fitness. Exercise devices often simulate different motions such as walking, running and climbing. Climbing exercise is particularly advantageous because it exercises the upper and lower body simultaneously, and it efficiently and effectively exercises all the major muscle groups of the body.

Existing climbing devices presently available in the market typically emulate a climbing motion by providing for moveable handles and foot pedals, which move in a generally predetermined pattern or range of motion. During operation of such a device, a user grasps the handles and places his or her feet onto the pedals. The user then exercises by pushing down on one pedal with one leg and pulling down with the arm on the handle on the same side of the device as the pedal being pushed down. With the handle and foot pedal securely fixed to a central frame, when the arm and leg of the user is moving downwardly on one side of the body, the arm and leg on the other side of the body moves upwardly. The handle and foot pedal on each side of the frame move together in sync as they are connected to each other through a chain. Users of existing climbing exercise devices are accordingly forced to work with such a synched movement set-up, which may not be desirable for a user that may prefer or may benefit from alternate movement routines.

Using chains for driving the handles and foot pedals can result in frequent maintenance and repair needs—especially as the exercise device ages. The resistance on the handles and pedals can often become uneven as it varies depending on the level of lubrication in the chain and gears that the chains travel through. The lubricating fluid used for lubricating the chain and gears generate smell, attract dirt, and create additional maintenance issues. Breakdown of the climbing exercise device due to a faulty or broken chain is not easy to fix, leading to extended downtime for the impacted climbing exercise device. Further, existing climbing exercise devices allow for only a single permanent inclination setting for the frame whereby all users, irrespective of their individual exercise needs, are forced to get their workout at the same inclination.

Accordingly, opportunities exist for an improved climbing exercise device that overcomes the shortcomings in the art.

SUMMARY

This summary is provided to introduce in a simplified form concepts that are further described in the following detailed descriptions. This summary is not intended to identify key features or essential features of the claimed subject matter, nor is it to be construed as limiting the scope of the claimed subject matter.

Embodiments according to the invention can provide methods and devices for climbing exercises.

According to one or more embodiments, a climber exercise machine comprises a frame connected to a base through a base connection. The frame is pivotable about the base connection, and the frame includes a right side and a left side. A right handle and a left handle are connected to the respective right and left sides of the frame. The right handle moves within a first range of motion, and the left handle moves within a second range of motion. A right pedal and a left pedal are connected to the respective right and left sides of the frame. The right pedal moves within a third range of motion, and the left pedal moves within a fourth range of motion. The right handle, the left handle, the right pedal, and the left pedal move generally in the same plane. An angle between the frame and a plane parallel to an underside of the base is adjustable while the climber exercise machine is mounted by a user.

According to one or more embodiments, the motion of the left and right handles and the left and right pedals are facilitated by one or more belt drive mechanisms.

According to one or more embodiments, the angle is adjustable with a hydraulic mechanism.

According to one or more embodiments, the resistance on the motion of the left and right handles and the left and right pedals are adjustable by a computer-controlled module.

According to one or more embodiments, the angle is adjustable among at least four angle settings comprising a scaling setting, a crawling setting, a lunging setting and an inverting setting.

According to one or more embodiments, the angle between the frame and the base is adjustable among angles comprising approximately 65°, 75°, 90° and 105°.

According to one or more embodiments, the machine is configured for upper body workout wherein the third and fourth range of motions is set to zero.

According to one or more embodiments, the machine is configured for lower body workout wherein the first and second range of motions is set to zero.

According to one or more embodiments, each of the first, second, third and fourth range of motions has a range value different from the other three range values.

According to one or more embodiments, each of the first, second, third and fourth range of motions is supported by a respective dedicated belt drive mechanism.

According to one or more embodiments, a resistance level to each of the first, second, third and fourth range of motions can be set to four different values.

According to one or more embodiments, the machine further comprises workout intensity levels comprising a novice level, an intermediate level, an advanced level, and an expert level.

According to one or more embodiments, the machine further comprises two retractable handles wherein the retractable handles are fixedly positioned such that the retractable handles do not include a range of motion.

According to one or more embodiments, the machine further comprises interchangeable handles and pedals.

According to one or more embodiments, the machine further comprises a controller configured for storing data in cloud, the data related to one or more of: heart rate, body temperature, average rate of speed, and endurance of a user.

According to one or more embodiments, the machine further comprises a controller configured for permitting a user to perform one or more of joining an online class, interacting with online users through a built-in camera, connecting wirelessly to music, and watching online videos through a built-in led display.

According to one or more embodiments, the machine is configured to provide an ability to move each of the hands and legs in a different motion relative to remaining of the hands and legs.

According to one or more embodiments, the machine further comprises one or more of a cell phone charging port, an audio input port, and a multi-media input port.

According to one or more embodiments, the machine further comprises a built-in led display.

According to one or more embodiments, the machine further comprises one or more of a speaker and a camera.

According to one or more embodiments, the machine further comprises at least one sensor for sensing one or more of: a highest reach of each handle, a lowest reach of each handle, a highest reach of each pedal, and a lowest reach of each pedal.

According to one or more embodiments, the machine further comprises one or more of: a vibration mechanism for vibrating each pedal, and a heating mechanism for heating each pedal.

According to one or more embodiments, the machine further comprises a pair of wireless virtual reality glasses for simulating a predetermined external location as selected by a user.

According to one or more embodiments, the machine further comprises a beverage cooler built into the frame.

According to one or more embodiments, the machine is further configured for adjusting a tempo of music being played on a speaker or audio outlet of the machine.

BRIEF DESCRIPTION OF THE DRAWINGS

The foregoing, as well as the following Detailed Description, is better understood when read in conjunction with the appended drawings. For the purposes of illustration, there is shown in the drawings exemplary embodiments; however, the presently disclosed subject matter is not limited to the specific methods and instrumentalities disclosed.

The embodiments illustrated, described, and discussed herein are illustrative of the present invention. As these embodiments of the present invention are described with reference to illustrations, various modifications or adaptations of the methods and or specific structures described may become apparent to those skilled in the art. It will be appreciated that modifications and variations are covered by the above teachings and within the scope of the appended claims without departing from the spirit and intended scope thereof. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

DESCRIPTION OF EMBODIMENTS ACCORDING TO THE INVENTION

The following description and figures are illustrative and are not to be construed as limiting. Numerous specific details are described to provide a thorough understanding of the disclosure. In certain instances, however, well-known or conventional details are not described in order to avoid obscuring the description. Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. It will be appreciated that same thing can be said in more than one way.

Alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure.

Figure 1:
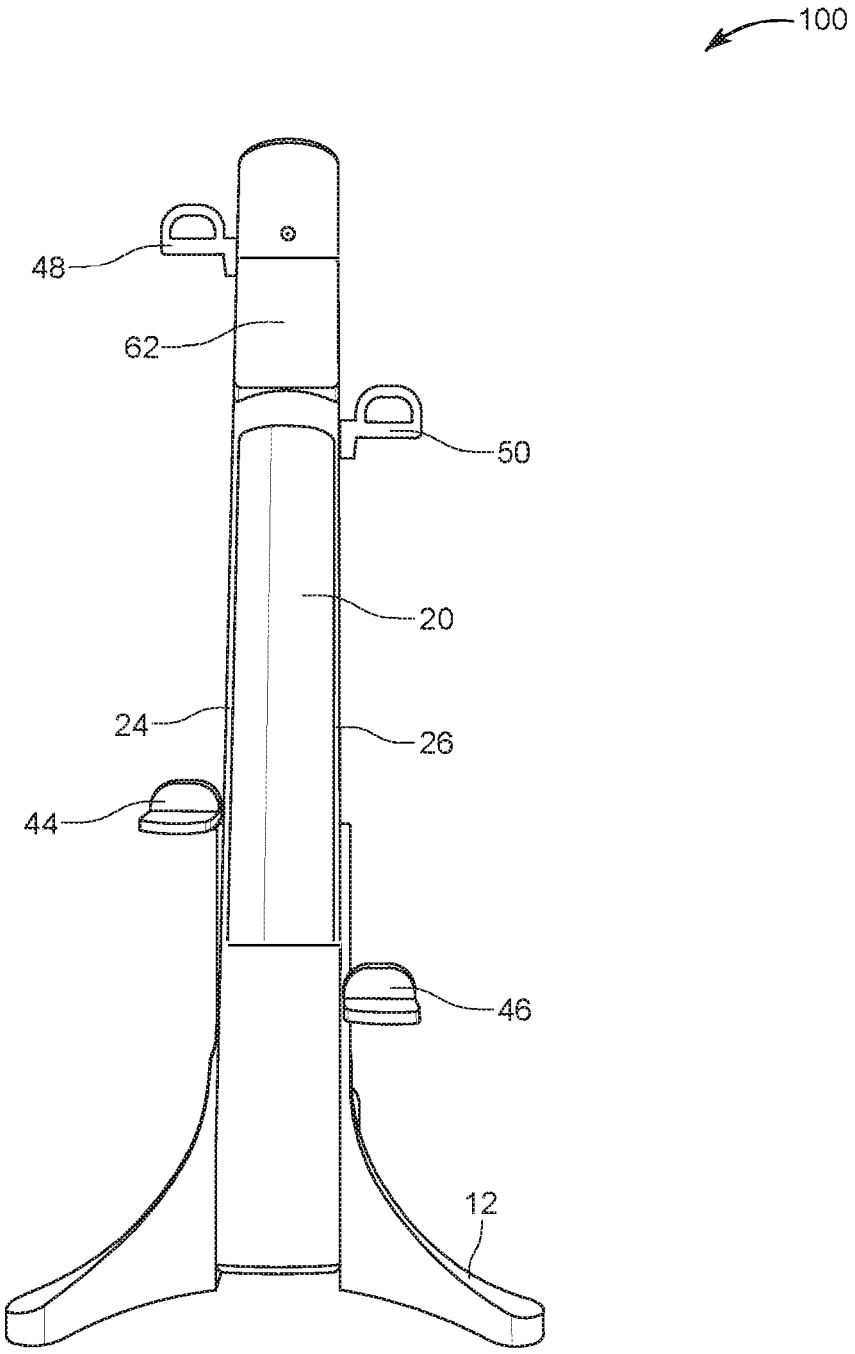
FIG. 1 illustrates a front perspective view of a climber exercise machine, according to one or more embodiments of the presently disclosed subject matter.
Figure 2:
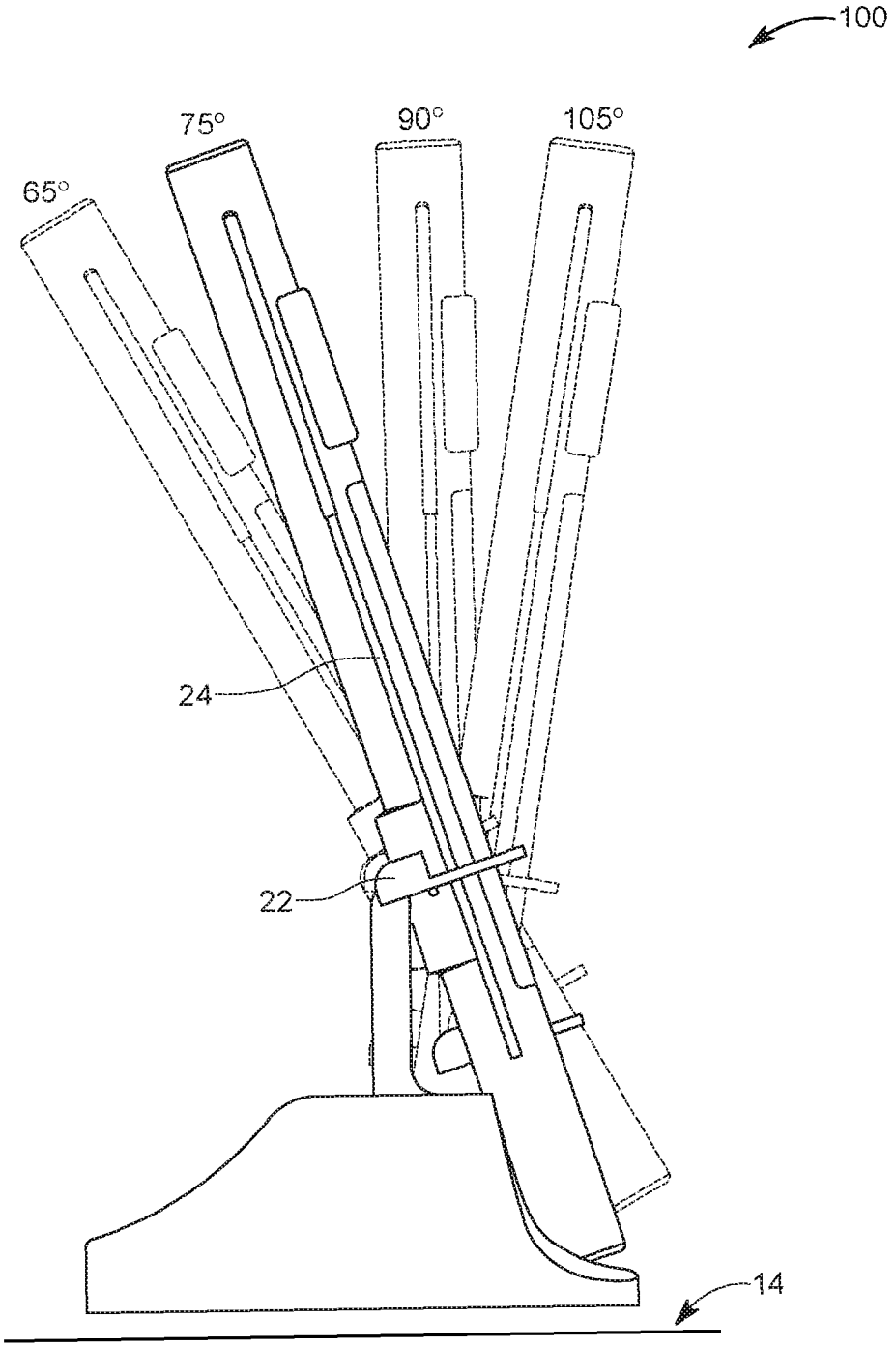
FIG. 2 illustrates a side perspective view of a climber exercise machine with its frame positioned at different inclinations, according to one or more embodiments of the presently disclosed subject matter.
Figure 3:
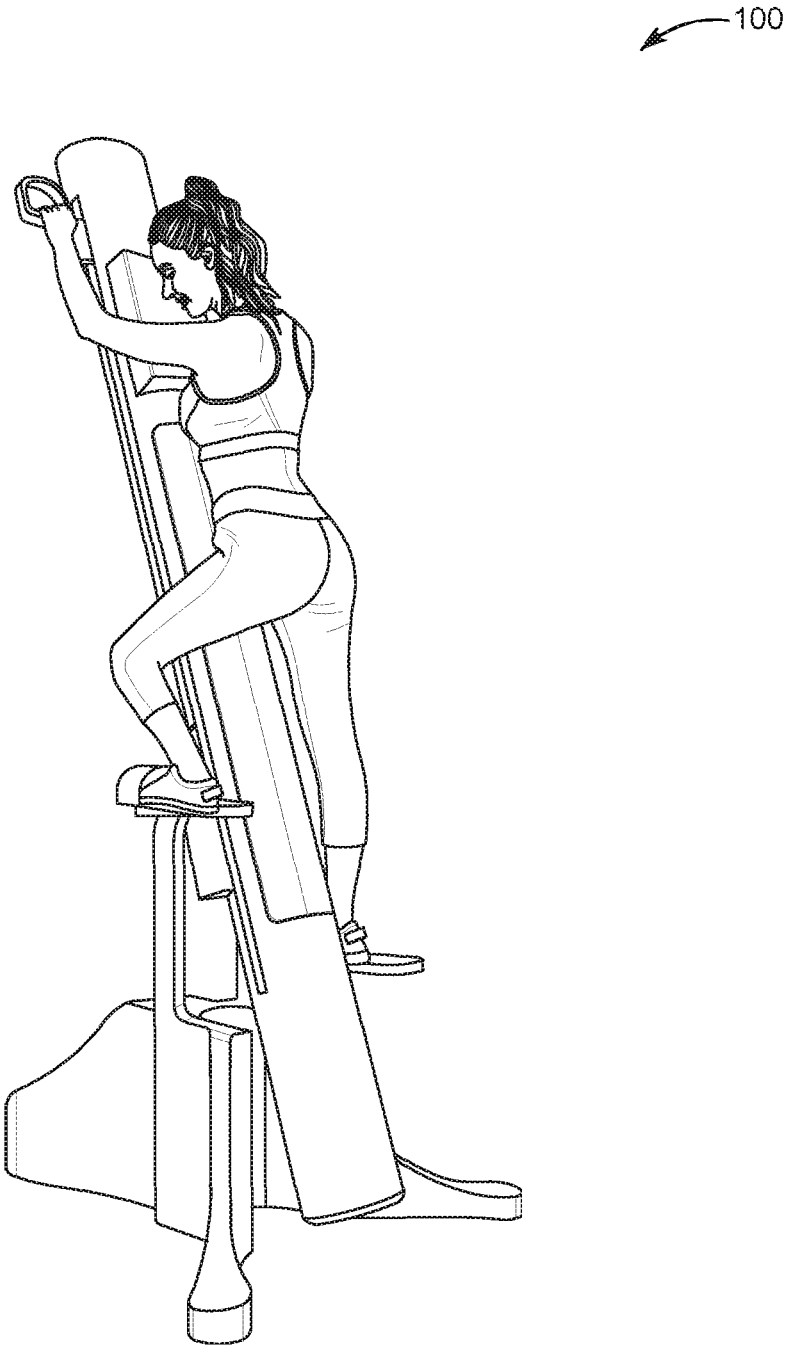
FIG. 3 illustrates a perspective view of a climber exercise machine in use by a person, according to one or more embodiments of the presently disclosed subject matter.
Figure 4:
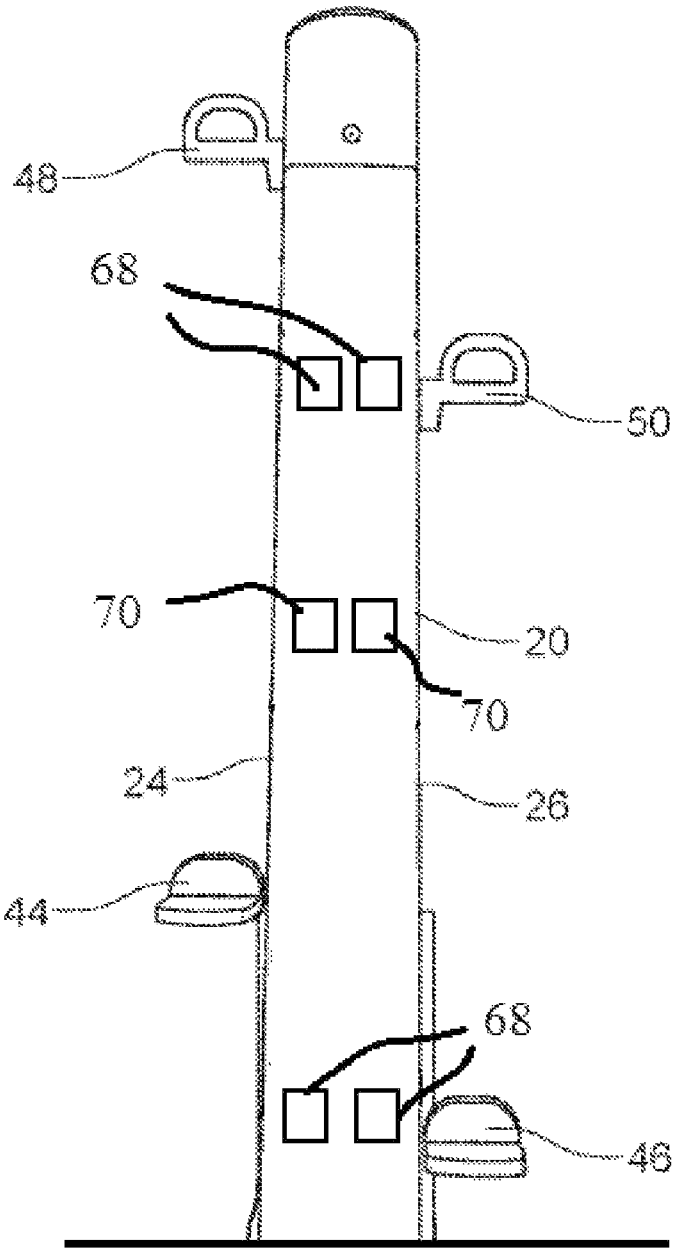
FIG. 4 illustrates a back perspective view of a climber exercise machine with the back portion cutaway to show the interior with sensors and belt drive mechanisms, according to one or more embodiments of the presently disclosed subject matter.
Figure 5:
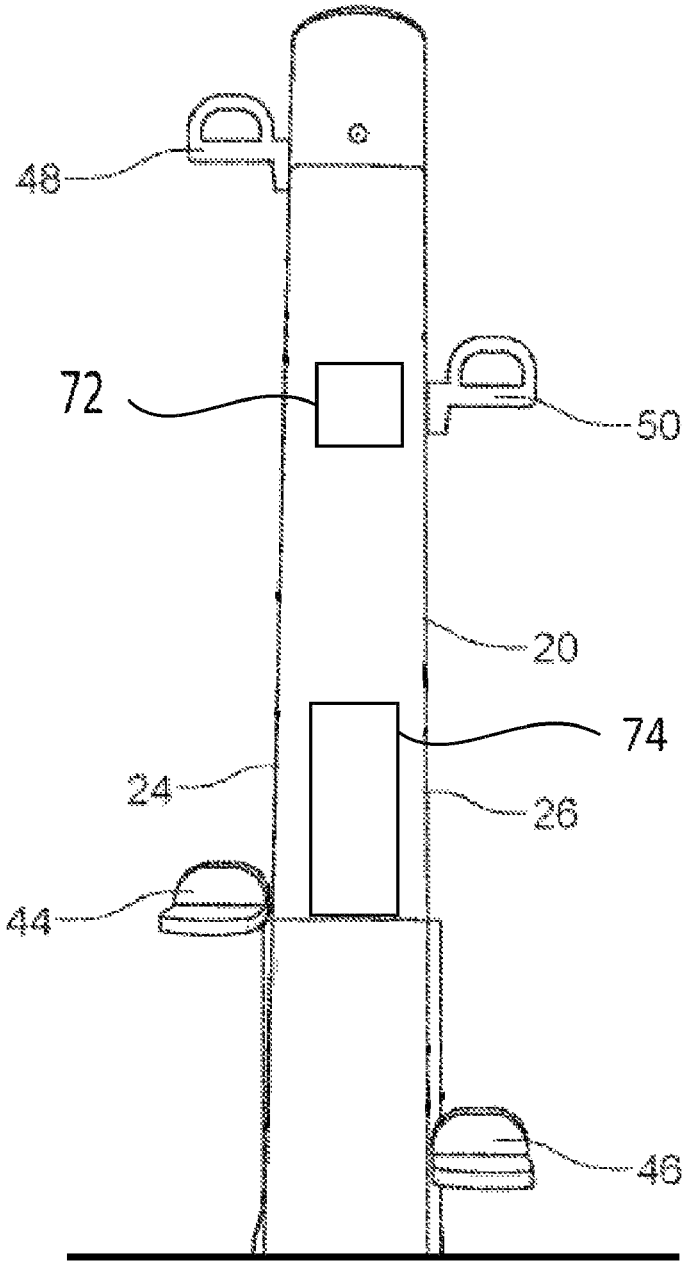
FIG. 5. Illustrates a back perspective view of a climber exercise machine, according to one or more embodiments of the presently disclosed subject matter.

As will be described in greater detail below with reference to the figures, the subject matter described herein provides for methods, devices and systems for providing climbing exercise. As seen in FIGS. 1-3, climber exercise machine 100 (alternately referred to herein as "machine 100" or simply "machine) is configured in accordance with one or more embodiments of the presently disclosed subject matter. According to various embodiments, climber exercise machine 100 includes a base 12 that supports other components of machine 100 on a generally flat surface such as a floor. According to at least one embodiment, base 12 includes three or more outwardly extending arms, at least a portion of each arm extending generally along a same plane to provide an essentially flat and stable surface that supports other components of machine 100. In various embodiments, the outwardly extending arms can be constructed of materials that include rectangular steel channels or other suitably rigid materials. The outwardly extending arms of base 12 can be of sufficient length and strength to support machine 100 with a user mounted thereon and exercising using machine 100. In one embodiment, the outwardly extending arms are securely connected to base 12 by a securing means such as bolts to create a stable base 12 for machine 100. In some embodiments, base 12 includes three or more outwardly extending arms welded together, or formed of a single piece of material such as steel.

Frame 20 connects to base 12 through base connection 22. Frame 20 is securely and pivotally held relative to base 12 by base connection 22 (see FIG. 2). Frame 20 is generally inclined at an angle measured from a horizontal plane 14, as illustrated in FIG. 2. Stated differently, a longitudinal axis passing through the center of frame 20 and extending through the length of frame 20 makes an angle with horizontal plane 14, with the angle being capable of being adjusted to different values. In various embodiments, the angle can be adjustable between 0 degrees (wherein the longitudinal axis passing through the center of frame 20 is parallel to the horizontal plane 14) and 180 degrees (wherein the longitudinal axis passing through the center of frame 20 is again parallel to the horizontal plane 14 but in an opposite direction as the zero degree disposition). In various embodiments, frame 20 can be formed of a metallic material such as steel to provide sufficient support for the user of machine 100. Other known materials could also be used for forming frame 20, including other types of metals such as aluminum, or nonmetal materials such as fiberglass, resins, plastics, ceramics and wood as well as combinations thereof. Similar to the construction of frame 20, other known materials could also be used for forming other components of machine 100, including other types of metals such as aluminum, or nonmetal materials such as fiberglass, resins, plastics, ceramics and wood as well as combinations thereof. Frame 20 and the other components of machine 100 can be joined by a variety of available means including as integral formation, brazing, soldering, bolting, screwing, adhesives and the like.

Frame 20 includes two longitudinally extending tracks provided on each lateral side of frame 20. As illustrated, for example, in FIG. 1, left side track 24 and right side track 26 are positioned along each lateral side of the frame 20, with left side track 24 and right side track 26 extending through a substantial portion of the length of frame 20. In at least one embodiment, each track may be in the form of a channel or a groove provided on either side of frame 20 with the channel or groove extending into the frame. The channel or groove can be provided spanning a substantial portion of the length of frame 20.

According to at least one embodiment, left pedal 44 and left handle 48 extend outwardly from left side track 24, as seen in FIG. 1; similarly, right pedal 46 and right handle 50 extend outwardly from right side track 26, also as seen in FIG. 1. Pedals 44 and 46 are located proximate base 12 of machine 100 with pedals 44 and 46 being configured for receiving the feet of a user of machine 100. In at least one embodiment, each of pedals 44 and 46 includes a stirrup or strap to keep a user's foot in contact with the pedal or otherwise secure the user's foot when the user is exercising on machine 100. In one embodiment, pedals 44 and 46 are constructed of a material such as plastic. Pedals 44 and 46 can further include a friction surface to avoid slipping of the user's feet during exercising. According to at least one embodiment, pedals 44 and 46 can be releasably attached to frame 20 through a quick release mechanism provided at or near a distal end of the pedal, wherein a proximal end of the pedal represents the free end. According to at least one embodiment, handles 48 and 50 can include cylindrical, padded and elongated grips. The grips provide for comfortable holding of the handles by the user. Handles 48 and 50 can be releasably attached to frame 20, for example, through a quick release mechanism provided at or near a distal end of each handle, for example, wherein a proximal end of each handle represents the free end. The releasable attachment of each of handles 48 and 50 and of pedals 44 and 46 can provide for swapping out handles 48 and 50 with pedals 44 and 46 and vice versa.

As seen in FIG. 1, according to various embodiments, a computing device such as computing device 62 is coupled to frame 20 of machine 100. Computing device 62 can include a computer-controlled module. Computing device 62 can include a touchscreen display and input keys. The input keys allow a user to input information for processing by a processor of computing device 62. The processor can provide a visual output to the user via the touchscreen display. The touchscreen display can include adjustability to allow the user to position the touchscreen display such that the touchscreen display can be easily seen and manipulated by the user irrespective of the height of the user. Computing device 62 can further include a memory that stores information and permits the user to select a pre-programmed exercise program or to configure an individualized exercise program. The processor is in electronic communication with the memory. The processor can also include the ability to store information at a remote location for analysis, for example. The remote location can represent the cloud in at least one embodiment. In various embodiments, the information received by the processor can be transferred wirelessly by the processor to a remote location comprising the cloud.

In various embodiments, computing device 62 is connected by a wire or other communication means to one or more sensors positioned at various predetermined locations of machine 100 and frame 20. The sensors can be in communication with the processor of computing device 62 with the sensors being configured to provide information and/or data to the processor of computing device 62. This information/data can allow the processor to calculate information related to climbing exercise being performed by a user, for example, including information on the speed of climbing, range of motion, work done and calories expended. The processor may also contain an internal clock or timing mechanism, which permits computing device 62 to display information such as the time spent exercising, or the time remaining to exercise in a preselected exercise program. This information may then be provided for viewing by the user on the display. This information can also be stored on the memory of computing device 62 by the processor. This information can be sent wirelessly to a remote location such as, for example, the cloud. In one embodiment, computing device 62 is addressable, operable, and/or updatable via one of a: USB port, a touch screen, a dial pad, an alpha-numeric key pad, a Wi-Fi connection, an Ethernet connection, a Bluetooth connection, a cellphone network tower connection and a satellite connection. In one embodiment, computing device 62 is capable of communicating with any device connected to the internet. In a further embodiment, computing device 62 is configured to provide visual updates to a user of machine 100. Computing device 62 communicates with a camera and a LED display module that forms part of machine 100. The processor of computing device 62 can execute a software that connects a user of machine 100 with one or more online classes.

The advantageous aspects of the presently disclosed subject matter can include one or more of the following features: (1) adjustability of frame 20 across four (or more) different angles; (2) ability to move each of handles 48 and 50 and pedals 44 and 46 in a different motion relative to the others; (3) belt driven technology for supporting the motion of each of handles 48 and 50 and pedals 44 and 46; and (4) computer controlled resistance level settings on each of handles 48 and 50 and pedals 44 and 46.

Machine 100 can include frame 20 that can be adjusted at four different angles to provide scaling, lunging, crawling and inverting type of exercises. Machine 100 can provide different motion levels and resistance settings to each pedal and handle. Pedals and handles can be interchanged for different types of exercises. Machine 100 can advantageously utilize a drive belt mechanism and computer-controlled resistance. Machine 100 can advantageously include unique technology to provide for lunging exercises.

In various embodiments, a resistance level to the motion of each of each of the left handle, the right handle, the left pedal and the right pedal can be adjustable by a computer-controlled module that forms part of, or is otherwise coupled to, computing device 62. The belt driven technology, that each of the handles and pedals are coupled to, can advantageously remove the need for oil lubrication, as may be the case with chain-driven technology.

Some embodiments of the presently disclosed subject matter are advantageously based on the "Parkour" exercise trend. As used herein, the term "Parkour" refers to a training discipline using movement that developed from military obstacle course training. Practitioners aim to get from one point to another in a complex environment, without assistive equipment and in the fastest and most efficient way possible. Parkour is a unique trend happening throughout urban societies. By providing for Parkour exercise routines, embodiments of the presently disclosed subject matter can advantageously provide a direct path to addressing areas of need for an athlete interested in Parkour exercises. Embodiments of the presently disclosed subject matter can further provide for the needs of an athlete interested in scaling walls, crawling underneath hurdles, lunging forward, and transitioning in an inverted way, among others.

According to at least one embodiment, machine 100 comprises a frame 20 connected to a base 12 through a base connection 22. Frame 20 is pivotable about the base connection 22. Frame 20 includes a right side and a left side. A right handle 50 and a left handle 48 are connected to the respective right and left sides of the frame 20, the right handle moving within a first range of motion, and the left handle moving within a second range of motion. A right pedal 46 and a left pedal 44 are connected to the respective right and left sides of the frame 20, the right pedal moving within a third range of motion, and the left pedal moving within a fourth range of motion.

According to various embodiments, machine 100 can be configured to provide an ability to move each of the hands and legs in a different motion relative to remaining of the hands and legs. The right handle, the left handle, the right pedal, and the left pedal are movable generally in the same plane. An angle between the frame and a plane parallel to an underside of the base is adjustable while the climber exercise machine is mounted by a user. According to various embodiments of the presently disclosed subject matter, motion of the left and right handles as well as the motion of the left and right pedals are facilitated by one or more belt drive mechanisms.

According to various embodiments, the angle formed between frame 20 and horizontal plane 14 can be adjusted with a hydraulic mechanism 74. According to various embodiments, the angle is adjustable among at least four angle settings comprising a scaling setting, a crawling setting, a lunging setting and an inverting setting. The angle between frame 20 and horizontal plane 14 can be adjustable among angles comprising approximately 65°, 75°, 90° and 105°. Several other angle settings can also be provided, with the change in angles accomplished by a hydraulic mechanism 74, for example. The angle between frame 20 and horizontal plane 14 can be changed while a user is mounted on the machine 100. In other words, the user does not have to get down of machine 100 before the angle between frame 20 and horizontal plane 14 can be changed. Also, changing the angle does not require any tools; it merely requires providing a command to computing device 62, which then uses a hydraulic mechanism 74 to accomplish the change in the angle. Accordingly, the angle between frame 20 and horizontal plane 14 is not permanently fixed whereby bolts may need to be moved from one slot to another to accomplish the change in angle. Stated differently, the angle change can be accomplished by the touch/push of a key/button on the display screen by the user, whether the user is mounted on the machine 100 or not; in some embodiments, the change in angle can be accomplished by sending a wireless signal to computing device 62 whereby there is no need for any physical contact (by the user) with any component of machine 100 to accomplish an angle change.

According to various embodiments, machine 100 can be configured for upper body workout by setting the third and fourth range of motions to zero. In other words, during an upper body workout setting, only the first and second ranges of motion are allowed whereas the third and fourth ranges of motion are inhibited by computing device 62 of machine 100. Parallelly, according to various embodiments, the machine 100 can be configured for lower body workout wherein the first and second ranges of motion is set to zero. In other words, during a lower body workout setting, only the third and fourth ranges of motion are allowed whereas the first and second ranges of motion are inhibited by computing device 62 of machine 100.

According to various embodiments, machine 100 can include two retractable handles that are fixedly positioned about frame 20 such that the retractable handles do not include a range of motion. In other words, each retractable handle can only be retracted into a cavity provided on the lateral side of frame 20, and pulled out of the cavity when needed; however, the retractable handles cannot be moved up or down along the longitudinal axis of frame 20.

According to various embodiments, each of the first range of motion, the second range of motion, the third range of motion, and the fourth range of motion has a range value different from the other three range values. This can be accomplished, for example, by providing for each of the first range of motion, the second range of motion, the third range of motion, and the fourth range of motion with its own respective dedicated belt drive mechanism. Stated differently, this can be accomplished by providing for each pedal and each handle with its own respective dedicated belt drive mechanism 70.

According to various embodiments of the presently disclosed subject matter, the resistance offered to the motion of the left and right handles and the motion of the left and right pedals are adjustable by a computer-controlled module forming part of computing device 62. In one embodiment, the resistance level offered to each of the first range of motion, the second range of motion, the third range of motion, and the fourth range of motion is configured to be set to four different values. Accordingly, computing device 62 can provide for setting the resistance to motion level corresponding to each of the first range of motion, the second range of motion, the third range of motion, and the fourth range of motion is configured to be set to four different values. In one embodiment, the user can set these levels on the touch screen display provided on machine 100.

According to at least one embodiment, machine 100 can further comprise different sets of interchangeable handles and pedals. The different sets of interchangeable handles and pedals can provide for customized exercise routines intended by the user. For example, when a user intends to use the crawl function, the user can switch out the existing handles and pedals with "crawl" handles and pedals, which represent a separate set of handles and pedals specially designed to support the crawl functionality. Controller 62 can further adjust the range of motions for the "crawl" handles and pedals to fit a pre-programmed crawl exercise routine.

Embodiments of the presently disclosed subject matter can further provide for different levels such as novice, intermediate, advanced and expert with increasing difficulty, for example, by way of increased resistance or increased range of motion provided for each hand and leg, and similar other technics to provide for increased exercising and muscle toning impact on the body of the user. Machine 100 can provide for an advanced user level that can only unlocked when the user achieves a predetermined level of expertise in using machine 100 such as, for example, an expert level status.

According to various embodiments, computing device 62 is configured for storing data and/or information as sensed by sensor provided on machine 100 in cloud. This data and/or information can be related to one or more of: heart rate, body temperature, average rate of speed, and endurance of a user of machine 100.

According to at least one embodiment, machine 100 includes a controller forming part of computing device 62. This controller is configured for permitting a user to perform functions such as: joining an online class, interacting with online users through a built-in camera of machine 100, connecting wirelessly to music files and playing the same via speakers 72 provided on machine 100, and watching online videos through a built-in led display of machine 100. According to at least one embodiment, machine 100 further comprises a cell phone charging port, an audio input port, and/or a multi-media input port. In one embodiment, machine 100 further comprises a built-in led display. In some embodiments, the machine further can further include a speaker 72 and/or a camera.

Embodiments of the presently disclosed subject matter can provide for various types of motions such as, for example, scale, crawl, lunge and invert motions. Embodiments of the presently disclosed subject matter can also include a hydraulic mechanism 74 capable of tilting frame 10 relative to base 12 depending on the intended exercise routine. For example, as shown in FIG. 2, scaling can be performed at a 90-degree angle; crawling can be performed at a 65-degree angle; lunging can be performed at a 75-degree angle, and inverting exercise can be performed at a 105-degree angle.

In addition to the change in the degree of inclination, embodiments of the presently disclosed subject matter can also provide the ability for a user to move the hands of the user at a different range of motion as comparted to the feet of the user. According to at least one embodiment, the motion of each arm and each leg can be controlled individually by computing device 62, with the motion of each arm and each leg being managed by belt driven mechanisms. Embodiments can also or alternatively provide for moving both hands up and both feet up at the same time; this can provide the functionality needed for the lunge exercise routine.

Embodiments of the presently disclosed subject matter can provide for controlling the resistance setting associated with the movement of each handle and each pedal. Embodiments of the presently disclosed subject matter can be further configured to measure data and provide analyses, with the resistance setting associated with the movement of each handle and each pedal capable of being adjusted through user interaction with the touchscreen display. Embodiments of the presently disclosed subject matter can provide the ability to create a higher or lower resistance to the movement of each handle and each pedal.

Machine 100 can further provide for a center core exercising routine. In at least one embodiment, machine 100 can include embedded dumbbells on the backside of the frame. In at least one embodiment, machine 100 can include hidden handles that a user can pull out for exercising the center core. Embodiments of the presently disclosed subject matter can provide a user the ability for lower body workout only; similarly, embodiments of the presently disclosed subject matter can provide a user the ability for workout upper body only.

Embodiments of the presently disclosed subject matter can provide for interchangeable handles and pedals that can provide for customized exercise routines intended by the user. For example, when a user intends to use the crawl function, the user will be able to switch out to the "crawl handles and pedals", which may be a separate set of handles and pedals specially designed to support the crawl functionality. The computing device 62 can further adjust the range of motions for the crawl handles and pedals to fit the crawl exercise routine.

Embodiments of the presently disclosed subject matter can include proprietary software installed on computing device 62 that can be updated periodically. The software can be installed locally, and the data associated with a user's exercise routines can stored in the cloud. The proprietary software can provide the user with interactive capabilities. The proprietary software can further provide for communication ability. Embodiments of the presently disclosed subject matter can also provide for the proprietary software operating on computing device 62 to be displayed on a built-in LED touchscreen panel. Embodiments of the presently disclosed subject matter can provide a user with the ability to adjust and change settings, select performance levels, join classes, participate on camera or off camera. Embodiments of the presently disclosed subject matter can further provide a local user of machine 100 with the ability to listen to music, view video, and similar other capabilities. Embodiments of the presently disclosed subject matter can provide for charging ports and charging technology that allows a user's smart device to stay on during exercising. Embodiments of the presently disclosed subject matter can further provide for downloading of an app such as, for example, a video-playing app and installing the same on computing device 62. Embodiments of the presently disclosed subject matter can additionally provide for high quality speakers 72 for sound to either play music local to a user or network music coming from an online real time class.

Embodiments of the presently disclosed subject matter can provide for a unique user ID that can be maintained and/or monitored by computing device 62. Each data set can be unique to each user ID. Embodiments of the presently disclosed subject matter can provide each user with a scanner badge or wristband or a unique ID number to input into machine 100 prior to use. The collected data can include data related to heart rate, body temperature, average rate of speed/time, distance/endurance and/or performance results. The data can be stored such that the user can keep track of progress. The data can also be correlated over a period giving the user daily rankings and monthly rankings compared to other users within a system that receives, stores and compares data on several users on several machines such as the machine 100 as disclosed herein. Embodiments of the presently disclosed subject matter can further provide for local, national and international competitions based on exercising on the machine as disclosed herein. The competitions and rankings can drive the user to improve performance and stay committed. This can ensure increased utility of machine 100 thereby driving end user success and retention rates.

Embodiments of the presently disclosed subject matter can be further configured to provide for a monthly subscription for enrolling to specific exercise classes to be performed on machines 100 located anywhere in the world. Embodiments of the presently disclosed subject matter can be further configured to provide a map of all users and locations worldwide along with the associated live class schedules. Embodiments of the presently disclosed subject matter can be further configured to provide a user with the ability to select any training location; for example, a user located in Miami, Fla. can be able to register for and take in a class conducted in Hollywood, Calif. in real time.

According to at least one embodiment, the climber exercise machine can include one or more sensors 68 to track reach (hereinafter referred to as "reach sensors"), and one or more sensors 68 to track steps (hereinafter referred to as "step sensors"). The reach sensors 68 and step sensors 68 can be configured to measure and alert for ranges of motion (e.g., each of the first range of motion, the second range of motion, the third range of motion, and the fourth range of motion) as well as speed associated with each of the ranges of motion (e.g., each of the first range of motion, the second range of motion, the third range of motion, and the fourth range of motion). The reach sensors 68 and step sensors 68 are configured to measure and alert for cross timing to maximize performance by the user of the climber exercise machine. According to at least one embodiment, eight sensors 68 are placed on left side track 24 and right side track 26 positioned along each lateral side of the frame 20 as follows: two sensors 68 are provided on the upper right region (i.e., upper region of right side track 26) two sensors 68 are provided on the lower right region (i.e., lower region of right side track 26), two sensors 68 are provided on the upper left region (i.e., upper region of left side track 24), and two sensors 68 are provided on the lower left region (i.e., lower region of left side track 24). Accordingly, in various embodiments, machine 100 further comprises sensors 68 for sensing aspects such as: a highest reach of each handle, a lowest reach of each handle, a highest reach of each pedal, and a lowest reach of each pedal, among others.

According to at least one embodiment, machine 100 includes provision for preventing a user's feet from "falling asleep" during an exercise session. A common challenge with typical climbing machines is a user's feet "falling asleep". To overcome this disadvantage, according to at least one embodiment, machine 100 includes a vibrating mechanism provided on each pedal and/or heated pedals with the vibration and heating settings capable of being controlled by the user to increase blood flows and limit the user's feet "falling asleep". Accordingly, in various embodiments, machine 100 further includes aspects such as a vibration mechanism for vibrating each pedal, and a heating mechanism for heating each pedal.

According to at least one embodiment, machine 100 includes a pair of wireless climbing safety glasses configured to simulate through virtual reality (VR) technics and background audio that can allow the climber to simulate various external environments while exercising using machine 100. For example, the wireless VR climbing safety glasses forming part of machine 100 can provide a user with the virtual reality of climbing a particular mountain, hill or building—as selected by the user. The wireless climbing safety glasses as well as computing device 62 can be provided with suitable proprietary software to simulate the needed virtual reality (VR) and audio. Accordingly, in various embodiments, the machine further comprises a pair of wireless virtual reality glasses for simulating a predetermined external location as selected by the user of machine 100, for example, when the machine is being used by the user.

According to at least one embodiment, machine 100 includes a built-in cooler for cooling a beverage container such as a water bottle, for example. In one embodiment, the built-in cooler can be similar to an electronic wine chiller. In one embodiment, the built-in cooler is built into frame 20. In one embodiment, the belt mechanism connected to the handles and pedals can be configured to power the cooling operations of the built-in cooler.

According to at least one embodiment, machine 100 includes a software such as a Drip™ audio software that allows a user with the ability to adjust the tempo of a music playing on the speakers 72 of machine 100 to thereby increase or decrease the tempo of using the Drip™ audio. This can advantageously permit a user to match a soundtrack to the user's real-time physical condition to measure and push for peak performance.

As will be appreciated by one skilled in the art, aspects of the present invention may be embodied as a system, method or computer program product. Accordingly, aspects of the present invention may take the form of an entirely hardware embodiment. Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter situation scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in a flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in a flowchart and/or block diagram block or blocks.

As will be appreciated by one skilled in the art, aspects of the present disclosure may be illustrated and described herein in any of a number of patentable classes or contexts including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product comprising one or more computer readable media having computer readable program code embodied thereon.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present inventive subject matter. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that when an element or layer is referred to as being "on" another element or layer, the element or layer can be directly on another element or layer or intervening elements or layers may also be present. In contrast, when an element is referred to as being "directly on" another element or layer, there are no intervening elements or layers present. As used herein, the term "and/or" includes any and all combinations of one or more of the associated listed items.

Spatially relative terms, such as "below", "beneath", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. Throughout the specification, like reference numerals in the drawings denote like elements.

Embodiments of the inventive subject matter are described herein with reference to plan and perspective illustrations that are schematic illustrations of idealized embodiments of the inventive subject matter. As such, variations from the shapes of the illustrations as a result, for example, of manufacturing techniques and/or tolerances, are to be expected. Thus, the inventive subject matter should not be construed as limited to the particular shapes of objects illustrated herein, but should include deviations in shapes that result, for example, from manufacturing. Thus, the objects illustrated in the figures are schematic in nature and their shapes are not intended to illustrate the actual shape of a region of a device and are not intended to limit the scope of the inventive subject matter.

The terminology used herein is for the purpose of describing particular embodiments only and is not intended to be limiting of the present inventive subject matter. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present inventive subject matter belongs. It will be further understood that terms used herein should be interpreted as having a meaning that is consistent with their meaning in the context of this specification and the relevant art and will not be interpreted in an idealized or overly formal sense unless expressly so defined herein. The term "plurality" is used herein to refer to two or more of the referenced item. Although any methods, devices, and materials similar or equivalent to those described herein can be used in the practice or testing of the presently disclosed subject matter, representative methods, devices, and materials are now described.

In the drawings and specification, there have been disclosed typical preferred embodiments of the inventive subject matter and, although specific terms are employed, they are used in a generic and descriptive sense only and not for purposes of limitation, the scope of the inventive subject matter being set forth in the following claims.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A climber exercise machine, comprising:

a frame connected to a base through a base connection;

a right handle and a left handle connected to the frame, the right handle moving within a first range of motion, the left handle moving within a second range of motion;

a right pedal and a left pedal being connected to the frame, the right pedal moving within a third range of motion, the left pedal moving within a fourth range of motion;

the right handle, the left handle, the right pedal, and the left pedal movable generally in a same plane, a dedicated left belt drive coupled to the left handle to provide resistance thereto, wherein the left dedicated belt drive is disposed within a left-side portion of the frame;

a dedicated right belt drive coupled to the right handle to provide resistance thereto, wherein the right dedicated belt drive is disposed within a right-side portion of the frame;

wherein the right handle and left handle are connected to the frame through a quick release connector disposed at or near a distal end of each of the right handle and left handle, wherein a proximal end of the left handle and right handle represents the free end.

2. The machine of claim 1, wherein the motion of the left handle is facilitated by the left belt drive and the motion of the right handle is facilitated by the right belt drive.

3. The machine of claim 1, wherein an angle between the frame and a plane parallel to an underside of the base is adjustable while the climber exercise machine is mounted by a user, wherein the angle is adjustable with a hydraulic mechanism.

4. The machine of claim 2, wherein a resistance level to the motion of each of the left handle and the right handle is adjustable by a computer-controlled module.

5. The machine of claim 3, wherein the angle is adjustable among at least four angle settings comprising a scaling setting, a crawling setting, a lunging setting and an inverting setting.

6. The machine of claim 1, wherein the first range of motion has a range value different from that of the second range of motion.

7. The machine of claim 1, wherein the first range of motion is supported by the right belt drive and wherein the second range of motion is supported by the left belt drive.

8. The machine of claim 1, wherein a resistance level to the first range of motion is configured to be different from a resistance level to the second range of motion.

9. The machine of claim 1, further comprising workout intensity levels comprising a novice level, an intermediate level, an advanced level, and an expert level.

10. The machine of claim 1, wherein the machine is further configured for storing data in cloud, the data related to one or more of: a heart rate, a body temperature, an average rate of speed, and an endurance of a user.

11. The machine of claim 1, wherein the right pedal and left pedal are connected to the frame through a quick release mechanism disposed at or near a distal end of both the right pedal and left pedal, wherein a proximal end of the left pedal and right pedal represents the free end.

12. The machine of claim 1, wherein the machine further comprises at least one sensor for sensing one or more of: a highest reach of each handle, a lowest reach of each handle, a highest reach of each pedal, and a lowest reach of each pedal.

13. The machine of claim 1, wherein the machine is further configured for adjusting a tempo of music being played on a speaker or audio outlet of the machine.

14. A climber exercise machine, comprising:

a frame connected to a base through a base connection;

a right handle and a left handle connected to the frame, the right handle moving within a first range of motion, the left handle moving within a second range of motion;

a right pedal and a left pedal being connected to the frame, the right pedal moving within a third range of motion, the left pedal moving within a fourth range of motion;

the right handle, the left handle, the right pedal, and the left pedal movable generally in a same plane, a dedicated left belt drive coupled to the left handle to provide resistance thereto, wherein the left dedicated belt drive is disposed within a left-side portion of the frame;

a dedicated right belt drive coupled to the right handle to provide resistance thereto, wherein the right dedicated belt drive is disposed within a right-side portion of the frame;

wherein the right handle and left handle are connected to the frame through a quick release connector disposed at or near a distal end of each of the right handle and left handle, wherein a proximal end of the left handle and right handle represents the free end;

wherein the right handle and left handle are retractable from a first position to a second position and wherein the free end of each of the right handle and left handle is disposed adjacent to the frame in the second position.

15. A climber exercise machine, comprising:

a frame connected to a base through a base connection;

a right handle and a left handle connected to the frame, the right handle moving within a first range of motion, the left handle moving within a second range of motion;

a right pedal and a left pedal being connected to the frame, the right pedal moving within a third range of motion, the left pedal moving within a fourth range of motion;

the right handle, the left handle, the right pedal, and the left pedal movable generally in a same plane, wherein each of the right handle, the left handle, the right pedal, and the left pedal are coupled to a respective, dedicated belt drive for providing resistance thereto on an individual basis; and wherein an angle between the frame and a plane parallel to an underside of the base is adjustable while the climber exercise machine is mounted by a user, wherein the angle is adjustable with a hydraulic mechanism.

16. The machine of claim 15, wherein the motion of the left handle and the right handle and the left pedal and the right pedal are facilitated by the one or more belt drives.

17. The machine of claim 16, wherein a resistance level to the motion of each of each of the left handle, the right handle, the left pedal and the right pedal is adjustable by a computer-controlled module.

18. The machine of claim 15, wherein the angle is adjustable among at least four angle settings comprising a scaling setting, a crawling setting, a lunging setting and an inverting setting.

19. The machine of claim 15, wherein the machine is configured for upper body workout when the third range of motion and the fourth range of motion are set to zero, and wherein the machine is configured for lower body workout when the first range of motion and the second range of motion are set to zero.

20. The machine of claim 15, wherein each of the first range of motion, the second range of motion, the third range of motion, and the fourth range of motion has a range value different from the other three range values.

21. The machine of claim 15, wherein each of the first range of motion, the second range of motion, the third range of motion, and the fourth range of motion is supported by a respective dedicated belt drive.

22. The machine of claim 15, wherein a resistance level to each of the first range of motion, the second range of motion, the third range of motion, and the fourth range of motion is configured to be set to four different values.

23. The machine of claim 15, further comprising workout intensity levels comprising a novice level, an intermediate level, an advanced level, and an expert level.

24. The machine of claim 15, further comprising two retractable handles wherein the retractable handles are fixedly positioned about the frame such that the retractable handles do not include a range of motion.

25. The machine of claim 15, wherein the machine is further configured for storing data in cloud, the data related to one or more of: a heart rate, a body temperature, an average rate of speed, and an endurance of a user.

26. The machine of claim 15, wherein the machine is further configured to provide an ability to move each of the hands and legs in a different motion relative to remaining of the hands and legs.

27. The machine of claim 15, wherein the machine further comprises at least one sensor for sensing one or more of: a highest reach of each handle, a lowest reach of each handle, a highest reach of each pedal, and a lowest reach of each pedal.

28. The machine of claim 15, wherein the machine is further configured for adjusting a tempo of music being played on a speaker or audio outlet of the machine.

* * * * *